United States Patent [19]

Beach et al.

[11] 4,324,314

[45] Apr. 13, 1982

[54] MUFFLER

[75] Inventors: Earl Beach, Royal Oak; Calvin Matle, Farmington, both of Mich.

[73] Assignee: Ross Operating Valve Company, Detroit, Mich.

[21] Appl. No.: 192,314

[22] Filed: Sep. 30, 1980

[51] Int. Cl.[3] ..... F01N 1/24

[52] U.S. Cl. ..... 181/230; 181/258

[58] Field of Search ..... 181/230, 252, 258; 55/276; 173/DIG. 2; 415/119

[56] References Cited

U.S. PATENT DOCUMENTS 1,627,324 5/1927 Green ..... 181/258

3,949,828 4/1976 Frochaux ..... 181/230

FOREIGN PATENT DOCUMENTS 2727281 12/1978 Fed. Rep. of Germany ..... 181/258

9414 of 1914 United Kingdom ..... 181/258

*Primary Examiner*—L. T. Hix

*Assistant Examiner*—Thomas H. Tarcza

*Attorney, Agent, or Firm*—Harness, Dickey & Pierce

[57] ABSTRACT

A muffler assembly particularly adapted to silence the exhaust air from an air valve of an air system. The muffler is constructed so as to permit effective silencing without significantly increasing valve and/or system response times. In addition, the design provides long life by permitting the retention of foreign matter in the exhaust air without significantly increasing the restriction to flow or decreasing the performance of the muffler. The muffler includes an inlet, an expansion chamber, a packing of woven material and an exhaust opening in that sequence.

14 Claims, 5 Drawing Figures

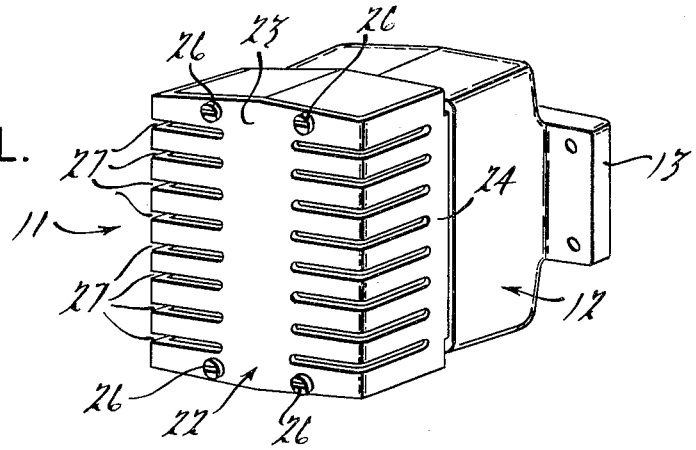
FIG. 1.
FIG. 2.
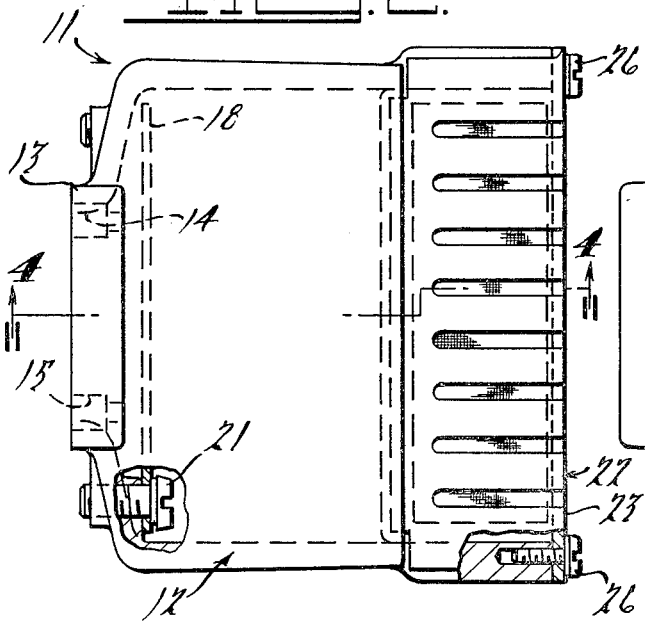
FIG. 3.
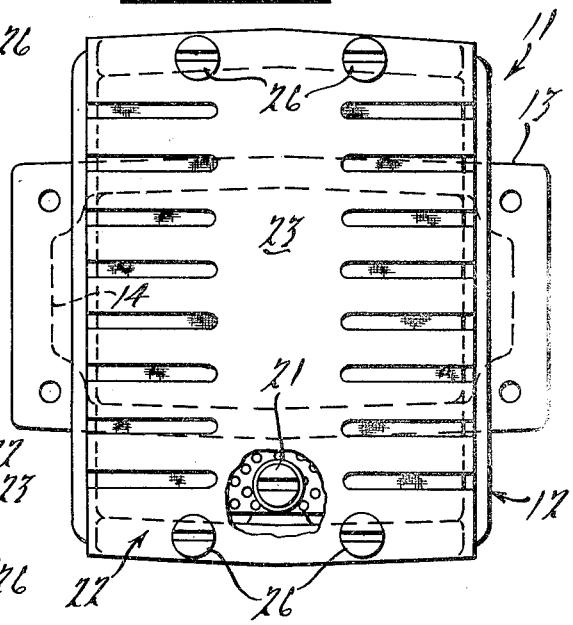
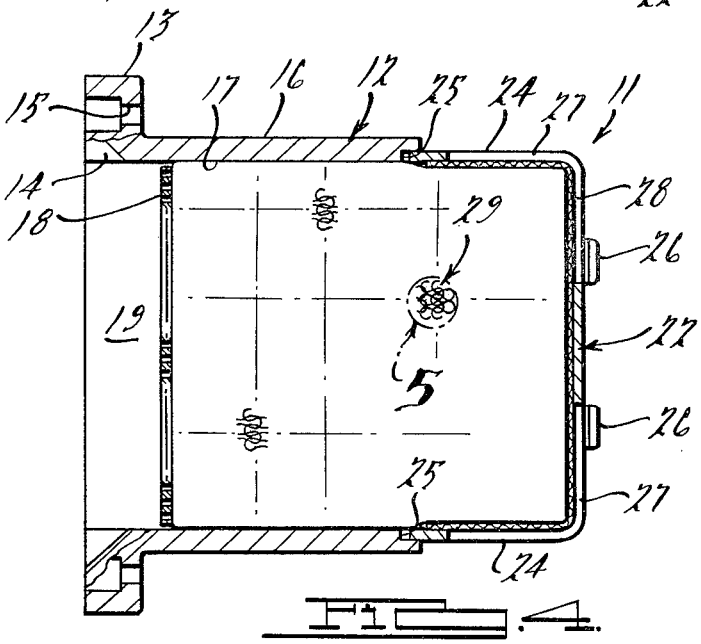
FIG. 4.
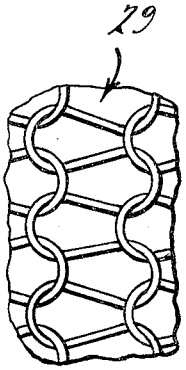
FIG. 5.

MUFFLER

BACKGROUND OF THE INVENTION

This invention relates to a muffler for an air system and more particularly to an improved exhaust muffler for an air valve or the like.

As is well known, most pneumatic systems include valves or other devices which, under certain cycles of operation, discharge exhaust air to the atmosphere. Quite frequently the exhaust air is discharged at high pressures and the desirability of silencing such exhausts should be readily apparent. However, certain problems are associated with the design of the muffler for such an application. In addition to providing effective silencing, the muffler should be capable of passing large amounts of air in a relatively brief of time. That is, the muffler should not offer any significant resistance to air flow or the response time of the associated system could be lengthened undesirably. In addition, the air in most air systems is contaminated by the entranment of foreign particles. The muffler must be capable of operation over extremely long life cycles even though it may accumulate these foreign materials without a decrease in the effectiveness of the muffling or a substantial increase of the muffler's resistance to air flow. In addition, the high shock impact of the exhaust air must be resisted by the muffler without degrading its performance or fatigue failure. Inconsistent with the aforenoted requirements is the necessity of the muffler to be compact and the desirability of maintaining a low cost.

It is, therefore, a principle object this invention to provide an improved muffler for an air system.

It is another object of this invention to provide an air system muffler that provides effective silencing and at the same time does not offer significant resistance to air flow.

It is a further object of the invention to provide an air system muffler which will provide long life, low cost and good performance throughout its life.

SUMMARY OF THE INVENTION

This invention is adapted to be embodied in a muffler assembly for muffling the exhaust of an air valve or the like. The muffler assembly comprises an outer housing that defines an inlet that is adapted to be positioned in registry with the exhaust outlet of an air valve or the like. The housing defines an internal cavity which is in communication with the inlet and which is also in communication with an exhaust. A packing of sound deadening material is interposed in the cavity in the path of air flow from the inlet to the exhaust. The packing is comprised of a knitted mesh of fibers.

BRIEF DESCRIPTION OF THE DRAWINGS

FIG. 1 is a front perspective view of a muffler embodying this invention and showing the muffler as it would appear when mounted on an associated valve body.

FIG. 2 is an enlarged side elevational view, with portions broken away of the muffler.

FIG. 3 is a front elevational view, with a portion broken away.

FIG. 4 is a cross-sectional view taken along the line 4—4 of FIG. 2.

FIG. 5 is an enlarged perspective view showing the packing material used in the muffler.

DETAILED DESCRIPTION OF THE PREFERRED EMBODIMENT

In the drawings the reference numeral 11 indicates generally a muffler assembly embodying in this invention. The muffler 11 is particularly adapted for used in conjunction with pneumatic valve assemblies for muffling the sound of discharge air when the valve is opened to the atmosphere to relieve pressure in the associated system. As such, the muffler 11 should provide effective silencing while at the same time permitting sufficient flow so as to not lengthen the response time of the system. Furthermore, muffler 11 must be capable of operating effectively over a great number of cycles and be capable of withstanding the contamination of its packing material by foreign products carried by the air which is discharged through it. That is, the build up of these contaminates within the muffler 11 should not significantly decrease its flow capacity or lengthen system response time.

The muffler 11 consists of a main housing 12 that is formed from cast metal or the like. The housing 12 has at its rearward end a mounting flang 13 which forms a generally rectangular inlet opening 14 that is adapted to be in registry with the discharge port of the associated valve (not shown). The flange 13 is formed with counterbored apertures 15 that are adapted to pass bolts or the like so as to permit attachment of the muffler assembly 11 to the associated valve.

Adjacent to the mounting flange 13, the housing 12 has main body part 16 in which a central opening or cavity 17 is formed. Spaced inwardly from the opening 14 and within the cavity 17 is a baffle plate 18. The baffle plate 18 is mounted to a rear wall of the housing 12 by means of a pair of screws 21. The mounting of the baffle plate 18 inwardly of the mouth of the opening 14 provides an expansion chamber 19 which serves to provide the initial muffling stage.

A generally U shaped sheet metal cover plate 22 has its central portion 23 extending across an opening formed at the exit end of the body portion 16. From the central portion 23, sides 24 of the cover plate extended along the sides of the body portion 16 and have tabs that are received in recesses 25 of the housing body portion 16. The cover plate 22 is afixed to the housing 12 by means of screws 26. Exit openings 27 in the form of slots extend from opposite sides of the center plate 23 into the sides 24. The exit openings 27 permit the discharge of the muffled air to the atmosphere.

The primary muffler function is performed by a packing material that is contained within the housing cavity 17 between the baffle plate 18 and the cover plate 22. An anti-extrusion screen 28 underlies the cover plate 22 and prevents this packing material from extruding through the openings 27 under the high impact of the exhaust air from the associated valve.

The packing material is indicated generally by the reference numeral 29 and its construction is shown in most detail in FIG. 5. The packing material 29 is preferably formed as a polypropylene knitted mesh formed from rectangular strands that are interwoven in a manner best shown in FIG. 5. This material has been found to provide the appropriate porosity when packed into the cavity 17 so as to achieve good muffling while at the same time permitting good valve response times. That is, the muffling is achieved without a significant reduction of the volume of air which may be discharged in a given time period. This material is also relatively impervious to distruction by the high velocity of air blasts and is capable of retaining substantial quantities of foreign material entrained in the associated air without substantially increasing the flow resistance through the muffler 11.

As has been noted, the expansion chamber 19 serves as the initial muffling or sound attenuation phase. The baffle 18, in addition to protecting the packing 29 from erosion by reducing the effect of air blasts performs a sound attenuating function. In a preferred embodiment, the baffle plate 18 is provided with a perforations so that it has an open area in a range of 20%–30%. The holes in the baffle plate with such an arrangement may have a diameter of 0.106 inches with approximately 33 holes per square inch of area. The baffle plate 18 is preferably formed from steel and has sufficient thickness so as to resist the impact loading and to provide sufficient strength from flexing fatigue due to repeatedly cycling.

The next silencing stage is provided by the packing material 29 and this constitutes the main silence portion of the muffler assembly 11. As has been noted, the packing material 29 comprises a knitted mesh formed from rectangular polypropylene strands. In a preferred embodiment of the invention, the packing density between the baffle plate 18 and the anti extrusion screen 28 falls in the range of 0.132 to 0.170 grams per cubic centimeter. The material has a specific gravity of approximately 0.905 and thus results in an apparent porosity in the range of 81%–86%. This porosity and packing density is found to give optimum ratio between silencing and valve response time.

The anti-extrusion screen 28 is preferably formed from a polyester screen material and in the preferred embodiment has 30×30 mesh with approximately 39% of open area.

The exhaust openings 27 are designed so as to have a total cross-sectional area that is greater than the cross-sectional flow area of the baffle plate 18. In a preferred embodiment of the invention, the effective cross-sectional area of the exhaust slots 27 is in the range of 125–180% of the effective flow area of the baffle plate 18.

As has been noted, the construction described provides extremely good sound attenuation without significantly degrading the response time of the associated pneumatic system. That is, the muffler assembly 11 does not significantly retard the air flow from the associate valve body even though a substantial amount of entrained material may become entrapped in the packing 29.

It is to be understood that the described construction is that of a preferred embodiment of the invention and that various changes and modifications may be made by those skilled in the art without departing from the spirit and scope of the invention as defined by the appended claims.

We claim:

1. A muffler assembly for muffling the exhaust of an air valve or the like comprising an outer housing defining an inlet adapted to be positioned in registry with the exhaust outlet of an air valve or the like, said housing defining an internal cavity in communication with said inlet, an exhaust in communication with said cavity, a packing of sound deadening material in it at least a portion of said cavity interposed in the path of flow from said inlet to said exhaust, said packing being comprised of a knitted mesh of fibers, a perforated baffle positioned between said inlet and the inlet end of the packing for attenuating sound and for protecting said packing from air blast damage, and an anti-extrusion screen positioned in engagement with the exhaust side of said packing for preventing discharge of said packing from said outer housing exhaust.

2. A muffler assembly as set forth in claim 1 wherein the packing has an effective porosity in the range of 80–90%.

3. A muffler assembly as set forth in claim 2 wherein the fibers of the packing are formed from polypropylene and have a generally rectangular cross section, the density therefore being in the range of 0.125–0.180 grams per cubic centimeter.

4. A muffler assembly as set forth in claim 1 wherein the baffle is positioned at a spaced distance from the mouth of the inlet to provide an initial silencing expansion chamber between said inlet mouth and said baffle.

5. A muffler assembly as set forth in claim 1 wherein the inlet baffle has an open area in the range of 25–35%.

6. A muffler assembly as set forth in claim 5 wherein the packing has an effective porosity in the range of 80–90%.

7. A muffler assembly as set forth in claim 6 wherein the baffle is positioned at a spaced distance from the mouth of the inlet to provide an intial silencing expansion chamber between said inlet mouth and said baffle.

8. A muffler assembly as set forth in claim 1 wherein the outer housing is provided with an open end in the side opposite the inlet and further including a generally U shape closure plate affixed across said open end, the exhaust comprising a plurality of slots formed in said cover plate.

9. A muffler assembly as set forth in claim 8 wherein the anti-extrusion screen is positioned in engagement with the cover plate and the packing for precluding extrusion of said packing through the cover plate slots.

10. A muffler assembly as set forth in claim 9 wherein the packing has an effective porosity in the range of 80–90%.

11. A muffler assembly as set forth in claim 9 wherein the baffle is positioned at a spaced distance from the mouth of the inlet to provide an initial silencing expansion chamber between said inlet mouth and said baffle.

12. A muffler assembly as set forth in claim 11 wherein the inlet baffle has an open area in the range of 25–35%.

13. A muffler assembly as set forth in claim 12 wherein the fibers of the packing are formed from polypropylene and have a generally rectangular cross section, the density therefore being in the range of 0.125–0.180 grams per cubic centimeter.

14. A muffler assembly as set forth in claim 1 wherein the packing is formed from a non-metallic material.

* * * * *